US006546574B1

(12) United States Patent
Bader

(10) Patent No.: US 6,546,574 B1
(45) Date of Patent: Apr. 15, 2003

(54) BABY BOAT

(76) Inventor: Robert F. Bader, 626 E. 17th St., Santa Ana, CA (US) 92705

( * ) Notice: Subject to any disclaimer, the term of this patent is extended or adjusted under 35 U.S.C. 154(b) by 0 days.

(21) Appl. No.: 09/946,358

(22) Filed: Sep. 6, 2001

Related U.S. Application Data

(60) Provisional application No. 60/230,696, filed on Sep. 7, 2000.

(51) Int. Cl.[7] ..... A47D 7/00; A47C 31/00

(52) U.S. Cl. ..... 5/94; 297/184.13

(58) Field of Search ..... 5/94, 655; 297/184.13

(56) References Cited

U.S. PATENT DOCUMENTS

| | | | | | |
|---|---|---|---|---|---|
| 2,628,358 | A | | 2/1953 | Neils | 2/69.5 |
| 4,366,587 | A | * | 1/1983 | Takada | 5/94 |
| 4,510,634 | A | | 4/1985 | Diedrich et al. | 5/98.3 |
| 4,571,760 | A | | 2/1986 | Kassal | 5/99.1 |
| 4,579,385 | A | * | 4/1986 | Koenig | 297/184.12 |
| 4,717,056 | A | | 1/1988 | Carmichael | 224/158 |
| 4,761,032 | A | * | 8/1988 | Sanchez et al. | 297/184.13 |
| 5,522,639 | A | * | 6/1996 | Jaime | 297/183.3 |
| 5,730,490 | A | * | 3/1998 | Mortenson | 297/184.11 |
| 5,806,924 | A | * | 9/1998 | Gonas | 160/37 |
| 5,819,341 | A | * | 10/1998 | Simantob et al. | 5/655 |
| 6,019,510 | A | * | 2/2000 | Gonzalez et al. | 224/409 |
| 6,039,393 | A | * | 3/2000 | Roh | 297/184.13 |
| 6,056,355 | A | * | 5/2000 | Klassen | 297/184.1 |

* cited by examiner

*Primary Examiner*—Thomas B. Will
*Assistant Examiner*—Tara L. Mayo
(74) *Attorney, Agent, or Firm*—Patent Trademark Services; Thomas Zack; Joseph H. McGlynn

(57) ABSTRACT

A portable baby carrier with a bed having sidewalls and two hoods which can be used alone or in conjunction with each other. Each hood is storable in a channel located in a sidewall of the carrier. The top hood extends to cover the infant's head and is made of a fabric material while the opposite end lower hood is made of a mesh net material. The mating facing edges of the two hoods zipper together to form a complete enclosure around the infant to protect the infant. Either hood may be used independent of the other.

5 Claims, 5 Drawing Sheets

BABY BOAT

This invention claims the benefit of the U.S. Provisional application No. 60/230,696 filed on Sep. 7, 2000.

BACKGROUND OF THE INVENTION

This invention relates to a portable baby bed having sidewalls and two hoods which can be used alone or in conjunction with each other.

Baby carriers of different sizes and configuration are known in the prior art. For example, in one earlier invention a baby carrier has a hood an integral blanket which zips closed to cover a carried infant. One additional carrier discloses a plastic frame and a resilient mesh material for supporting the infant.

Another carrier discloses a carry cot with a collapsible frame and a pair of carry handles.

Still another infant carrier has a hood at one end and a pair of carry straps.

DESCRIPTION OF THE PRIOR ART

Infant or baby carrier are disclosed in a variety of configurations and sizes. For example, U.S. Pat. No. 2,628,358 to Neils discloses a baby carrier which has a hood and an integral blanket which zips closed to cover a carried infant.

U.S. Pat. No. 4,510,634 to Diedrich et al. discloses a carrier with a plastic frame and a resilient mesh material for supporting an infant.

U.S. Pat. No. 4,571,760 to Kassal discloses a carry cot with a collapsible frame and a pair of carry handles.

U.S. Pat. No. 4,717,056 to Carmichael discloses an infant carrier that has a hood at one end and a pair of carry straps.

In the present invention a portable baby bed has sidewalls and two hoods which can be used alone or in conjunction with each other to fully enclose the bed all as will be detailed in the specification that follows hereafter.

SUMMARY OF THE INVENTION

This invention relates to a portable baby or infant carrier that has sidewalls and two hoods which can be used alone or in conjunction with each other to fully enclose the bed.

It is the primary object of the present invention to provide for an improved portable baby carrier that has protective hoods and sidewalls wherein the hoods may be individual or collectively closed or opened.

Another object is to provide for such a carrier where there is a soft bottom protected from wetting or stains and pockets both inside and outside the carrier.

These and other objects and advantages of the present invention will become apparent to readers from a consideration of the ensuing description and the accompanying drawings.

DESCRIPTION OF THE PREFERRED EMBODIMENT

Figure 1:
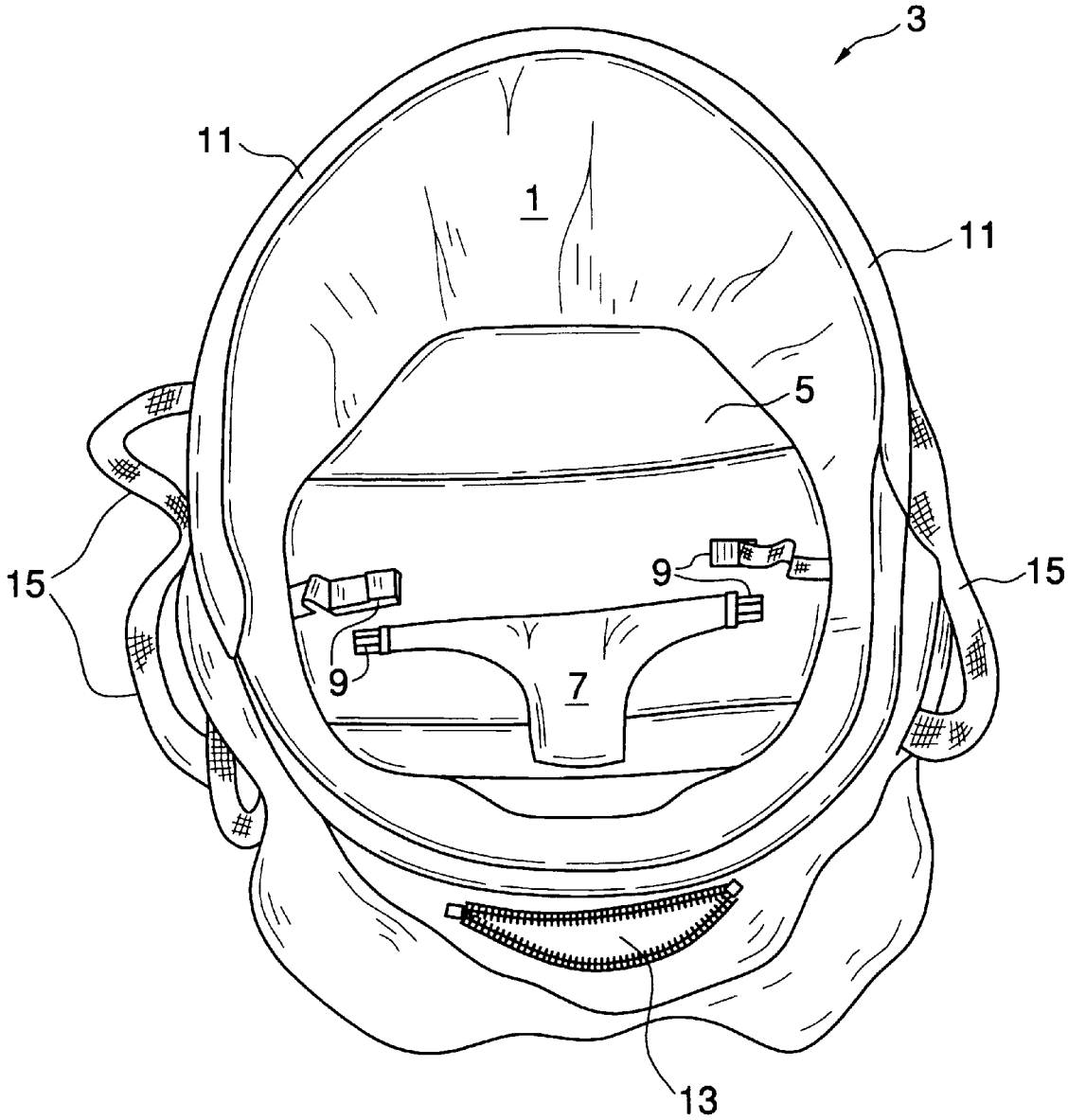
FIG. 1 is a perspective view of the present invention looking into the opened bed.

FIG. 1 is a perspective view of the present invention looking downwardly into the opened bed 1 of the portable carrier 3. Fabric makes up most of the outside material for the carrier with a reversible pad 5 covering an underlying clear vinyl sheet sewn into the fabric to prevent urine/stool soiling of the carrier's fabric material. Pad 5 is secured to the bottom surface of the carrier by VELCRO and twist-fasteners. A "Y" shaped security belt 7 detachably secured to the carrier on its two opposite ends 9 extends over the pad 5. Raised surroundings joined sidewalls 11 enclose the pad 5 where the infant is placed in a reclined position. The two surrounding sidewalls 11 each have three pockets sewn into their two opposite sides.

Figure 4:
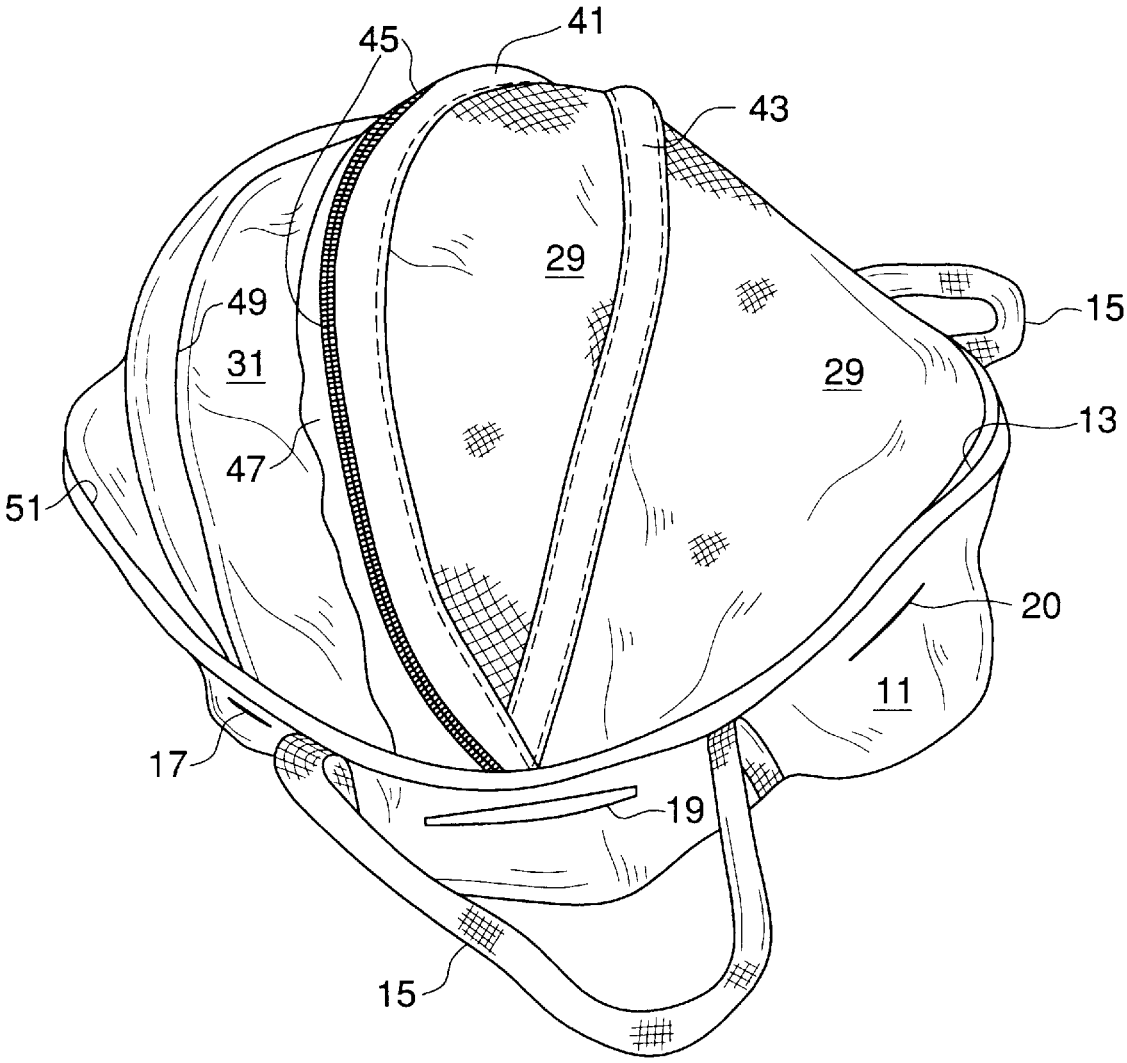
FIG. 4 is a perspective view with the two hoods closed.

At the top and bottom ends of the sidewalls 11 each have a concealed channel used to store a protective hood. The bottom or lower zippered channel 13 is shown in an opened position while the opposite side top channel is closed and concealed from view. An expandable hood is stored in the top channel and used to outdoor use as a sun hood. The lower channel 13 stores a net hood that can be extended for outdoor use. When extended from their two storage channels, the hoods interface with a closable zippered edge to permit both extended hoods to be joined together as best seen in FIG. 4. Extending and attached to the sides of the carrier 3 are two separate carrying straps 15, each of which is partially shown. Each strap 15 is flexible rope like member that is generally U-shaped and attached to the carrier on a side at its free ends.

Figure 2:
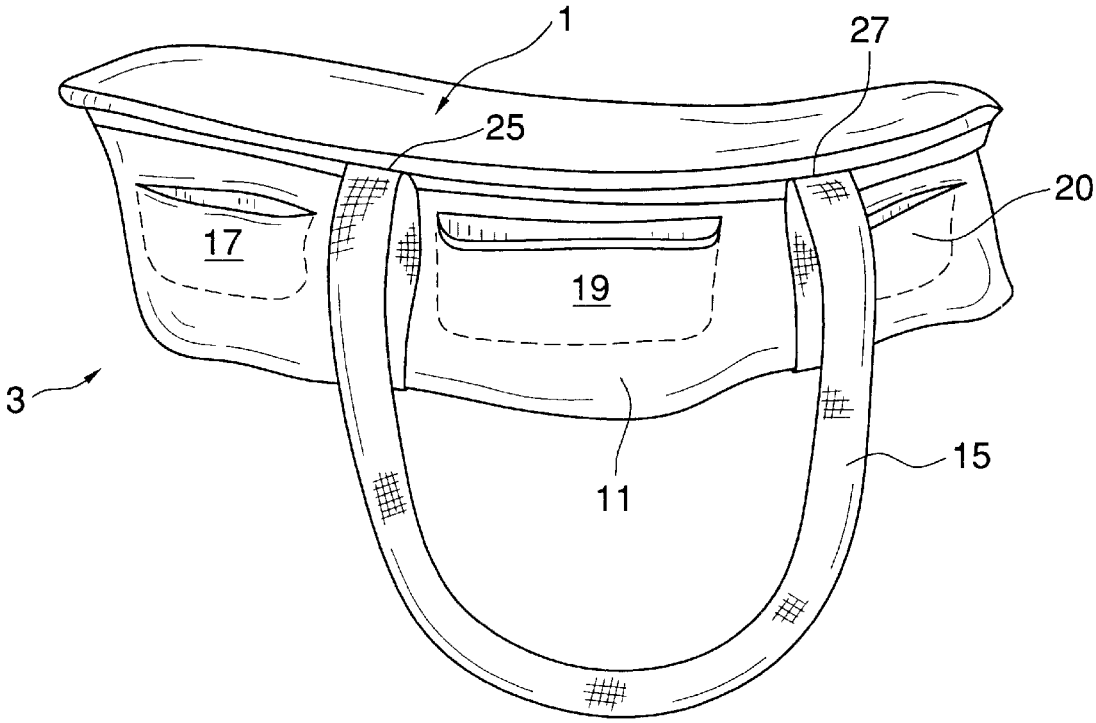
FIG. 2 is a perspective view looking from the side of the present invention.

FIG. 2 is a perspective view looking from one side of the present invention. The other side is substantially the same. As in the prior figure there is an opened bed 1 with both opposite end hoods stored in their respective storage channels. Three side pockets 17, 19 and 20 extend into the sidewall 11 on each side of the carrier. Pocket 17 has an opened zipper closure 21 surrounding its upper opening. Pocket 19 has a closed flap hook and loop closure 23 shown in a closed position. Elastic may also be used to close the opening of a pocket. Each pocket is comparable to a utility baby-bag and may store a variety of baby treatment items such as unused diapers, powers, baby bottles, food products, toys, etc. As is clear from this view the fabric making up the sidewalls 11, like denim, is flexible and soft. A high high density foam which passed flammability requirements is one other example of a material that can be used for the sidewalls 11.

The strap 15 on this side of the carrier is shown attached to the upper portion of the sidewall 11 at its two opposite ends 25 and 27. The other opposite side rope strap would be fastened to the carrier sidewall in a like manner.

Figure 3:
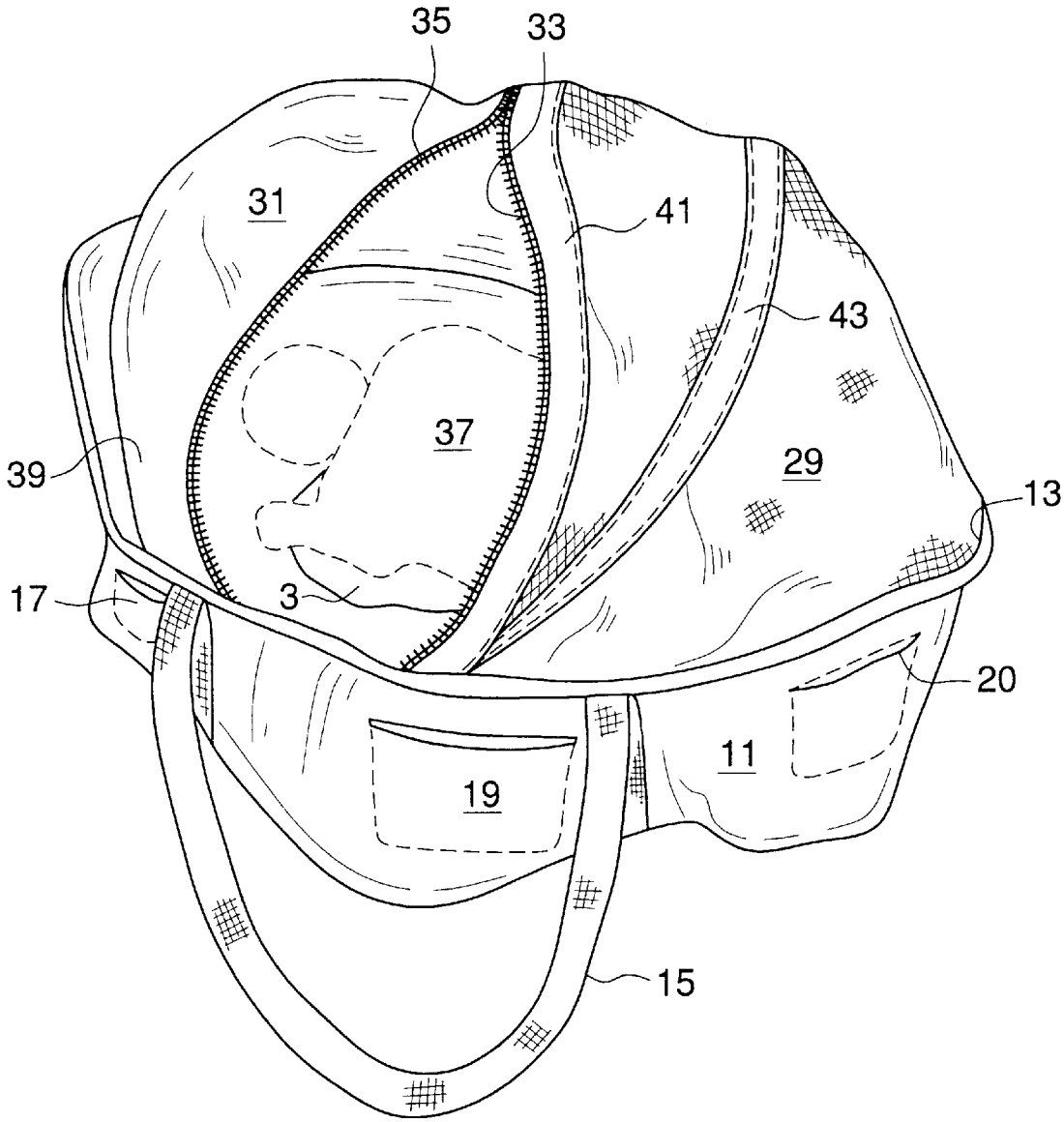
FIG. 3 is a perspective view with the two hoods partially closed.

FIG. 3 is a perspective view with the two carrier hoods 29 and 31 shown in a partially closed position. The lower net hood 29 is extended from its opened storage channel 13 and has a mating edge with a zippered edge 33 extending along the length of the edge. Mating with the edge 33 is the zippered edge 35 of hood 31. In FIG. 3 the two mating zippered edges 33 and 35 are engaged along part of their respective lengths to partially enclose the infant 37(shown in dotted line format) lying on pad 5 within the confines of the carrier. The mostly extended top hood 31 has its own sidewall storage channel 39 like channel 13 that may be closed by a zipper or hook and loop fastener to retain the collapsed hood.

Internal supporting frame members 41 and 43 on hood 29 are more sturdy than the net and supply supports for the flexible mesh net structure of the hood with one end (41) being used to attach the zippered edge 33. Similar firmer supporting frame members extend across the fabric making up hood 31 with one such member support the zippered edge 35. The three side pockets 17,19 and 20 in one of the two sidewalls 11 are also shown.

FIG. 4 is a perspective view with the two hoods 29 and 31 closed. Clearly either hood may be partially or totally opened or closed as desired as both hoods are independently adjustable by hand. FIG. 4 is viewed from a slightly different angle than FIG. 3. The two zippered hood edges 33 and 35 are fully engaged along their respective lengths along the closure line 45. The support internal frame members 47 and 49 for the top hood 31 are partially shown. A channel 51 along the top end sidewall is opened and used to store the hood 31. The mesh net making up the lower hood 29 is chosen to freely admit and dispense gases and breathable air into and from the enclosure while, protecting the infant from insects, like bees. The three side pockets 17, 19 and 20 are closed. Part of the other far side rope strap 15 is also visible in this figure.

Figure 5:
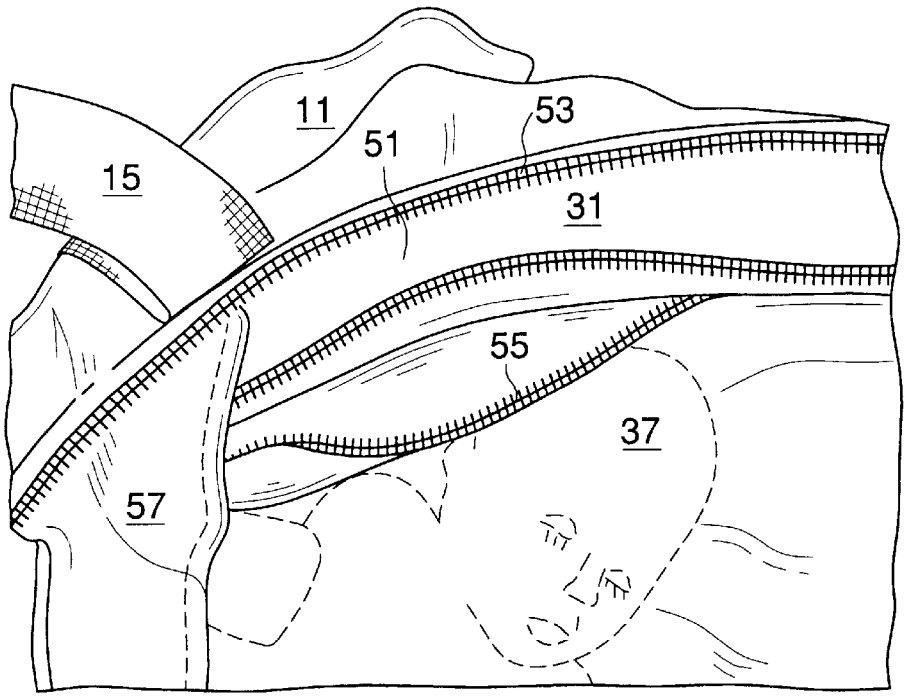
FIG. 5 is an enlarged perspective view of a portion of the front bed section with the adjacent hood open.

FIG. 5 is an enlarged perspective view of a portion of the front bed section with the adjacent top hood channel 51 opened. As with the lower hood receiving channel 13, facing zippered edges 53 and 55 permit the channel 51 to be closed to store the collapsed hood 31. In this figure only a small part of the sidewall 11 is visible as well as a segment of one of the carrier straps 15. Internal infant confining partitions 57 may also be provide within the confines 1 of the carrier 3.

Figure 6:
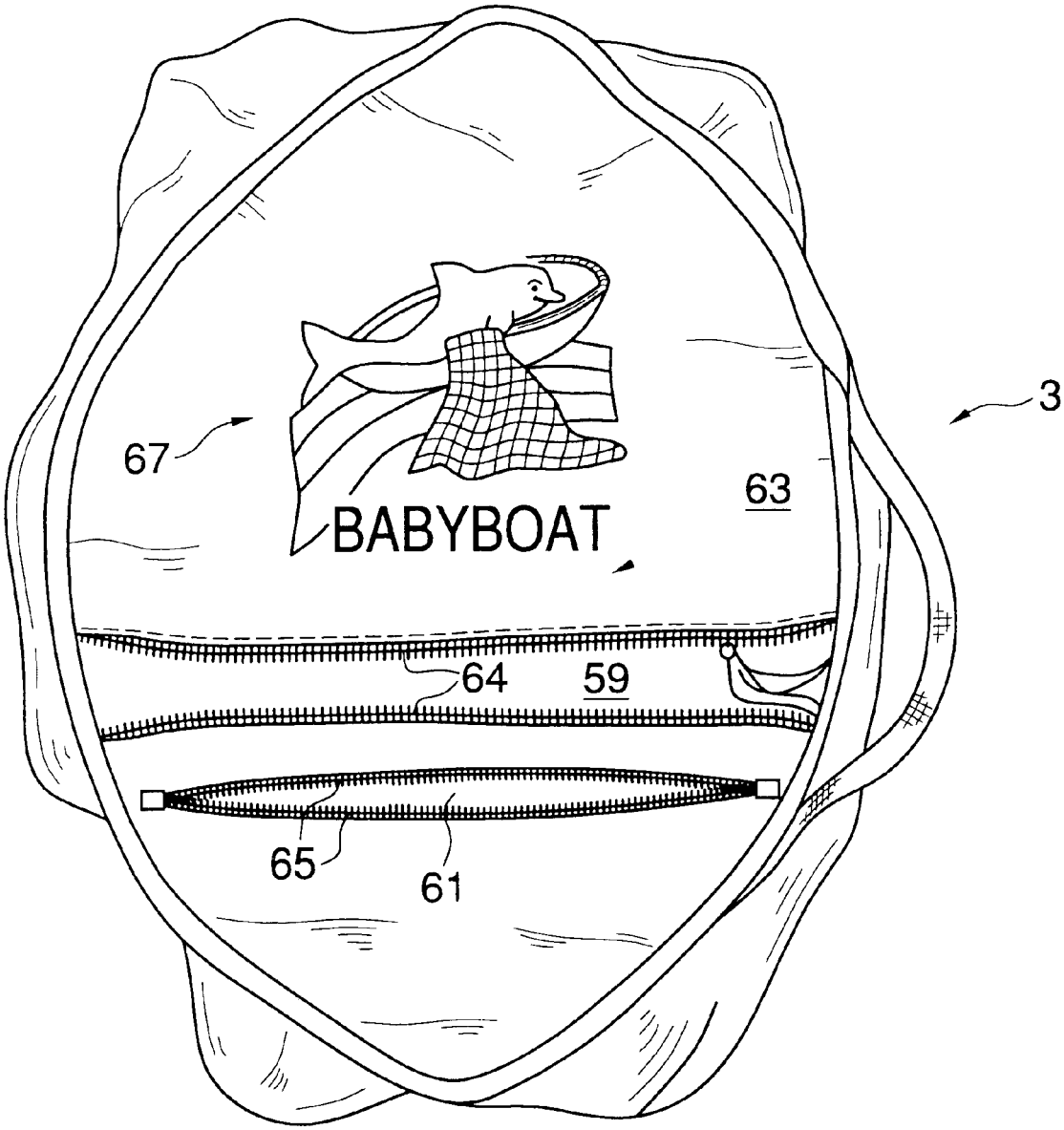
FIG. 6 is a bottom view of the carrier showing two pockets opened.

FIG. 6 is a bottom view of the carrier 3 showing two additional large storage pockets 59 and 61 in their opened positions. The bottom surface 63 is plastic lined to prevent staining if the carrier is accidentally placed on a dirty or wet surface. The pockets extend across most of the width of the carrier and have mate able zippered edges 63 and 65. These two bottom pockets can be used to temporarily store dirty items in plastic disposal bags. Written and drawing logos 67 may be placed on the bottom surface 63.

The portable carrier of this invention is light weight and can replace heavier bassinets, cribs or playpens when traveling. It can be used in an office by working moms and dads. On the road it can be used in restaurants and hotels as a complement to a car seat during travel. The carrier also can be used while visiting friends or in-laws and for distant travel while in a plane, train or boat. It may be used for pediatric examination when in an emergency room or medical office. The carrier is especially useful outdoors when an infant needs a protective barrier against insects and dusts. The disclosed configuration for the present invention and the related "Baby Boat" title is only shape format. Additional product development may lead to further travel themes used for the configuration of different embodiments such as, a race car, a military vehicle, a wagon, an aircraft, or some other popular configuration.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An infant carrier comprising:

a bottom surface and sidewalls, said sidewalls enclosing the bottom surface, said sidewalls having a top end and a bottom end, a first hood storable in the top end, said first hood being a sun hood used to block the passage of sunlight to an infant placed within the bottom surface while surrounded by the sidewalls, said first hood being independently extendable to cover a portion of said bottom surface, a second hood storable in the bottom end, said second hood having a protective net fabric to permit the passage of air to an infant placed within the carrier, said second hood being independently extendable to cover a portion of the bottom surface, said first hood and second hood having interfacing edges that can be closed together by a fastener, a first hood storage channel in the top end of said first hood, a second hood storage channel in the bottom end of said second hood, said first hood storage channel and said second hood storage channel each having fasteners to open and to close the channels, whereby said first and second hoods may be extended from their channels when the channel is opened and stored in their channels when the hoods are retracted and their channel is closed.

2. The infant carrier as claimed in claim 1, also including a carrying strap fixed to the sidewalls.

3. The infant carrier as claimed in claim 1, wherein said sidewalls have a plurality of storage pockets.

4. The infant carrier as claimed in claim 3, wherein said plurality of side storage pockets each have means for closing said side storage pockets.

5. An infant carrier comprising:

a bottom surface and sidewalls, said sidewalls enclosing the bottom surface, said sidewalls having a top end and a bottom end, a first hood storable in the top end, said first hood being a sun hood used to block the passage of sunlight to an infant placed within the bottom surface while surrounded by the sidewalls, said first hood being independently extendable to cover a portion of said bottom surface, a second hood storable in the bottom end, said second hood having a protective net fabric to permit the passage of air to an infant placed within the carrier, said second hood being independently extendable to cover a portion of the bottom surface, said first hood and second hood have interfacing edges that can be closed together by a fastener elements which extend substantially along the entire length of the interfacing edges of the first hood and the second hood.

* * * * *